US010689149B1

(12) United States Patent
Goode

(10) Patent No.: US 10,689,149 B1
(45) Date of Patent: Jun. 23, 2020

(54) PARTY ACCESSORY STORAGE AND DISPLAY UNIT

(71) Applicant: Charrondarous Goode, Richmond, VA (US)

(72) Inventor: Charrondarous Goode, Richmond, VA (US)

( * ) Notice: Subject to any disclaimer, the term of this patent is extended or adjusted under 35 U.S.C. 154(b) by 0 days.

(21) Appl. No.: 16/266,462

(22) Filed: Feb. 4, 2019

Related U.S. Application Data

(60) Provisional application No. 62/723,080, filed on Aug. 27, 2018.

(51) Int. Cl.
*B65D 5/42* (2006.01)
*B65D 5/50* (2006.01)
*A47G 19/06* (2006.01)

(52) U.S. Cl.
CPC ..... *B65D 5/4208* (2013.01); *A47G 19/06* (2013.01); *B65D 5/5023* (2013.01)

(58) Field of Classification Search
USPC ..... 229/902, 904; 206/457, 747, 557, 756, 206/757, 759, 774, 745
See application file for complete search history.

(56) References Cited

U.S. PATENT DOCUMENTS 1,498,516 A * 6/1924 Lee ..... A47G 21/14 206/742
1,589,218 A * 6/1926 Pinten ..... A47F 7/145 206/742
2,145,462 A * 1/1939 Speck ..... A45C 15/04 132/288
3,638,849 A 2/1972 Goings
3,722,781 A 3/1973 Page et al.
4,489,879 A 12/1984 Mode
4,936,463 A * 6/1990 Tiramani ..... A45C 5/005 132/315
4,981,217 A 1/1991 Lim
6,588,652 B2 7/2003 Cal
6,988,614 B2 1/2006 Hemingway et al.
7,232,055 B1 6/2007 Lim
2004/0178116 A1* 9/2004 Daetweiler ..... A45C 11/16 206/747

* cited by examiner

*Primary Examiner* — Jacob K Ackun
(74) *Attorney, Agent, or Firm* — Suzanne Kikel, Patent Agent

(57) ABSTRACT

A party accessory storage and display unit has a central portion with two spaced apart planar panels which form a U-shaped opening there between and a display panel hingeably and detachably mounted on the central portion to move between an open position and a closed position adjacent to the central portion. Two pivotal members are each pivotally connected to opposite sides of the central portion to move between a storage condition inside the U-shaped opening and a serving position outside of the U-shaped opening of the central portion. The central portion and the two pivotal members have several compartments for holding accessory items for a social event. A display panel is hingeably attached to the central portion for displaying selected indicia. The unit is easily adapted to be supported by different configurations and sizes of tables, and is easily set up, taken down, and transported.

5 Claims, 1 Drawing Sheet

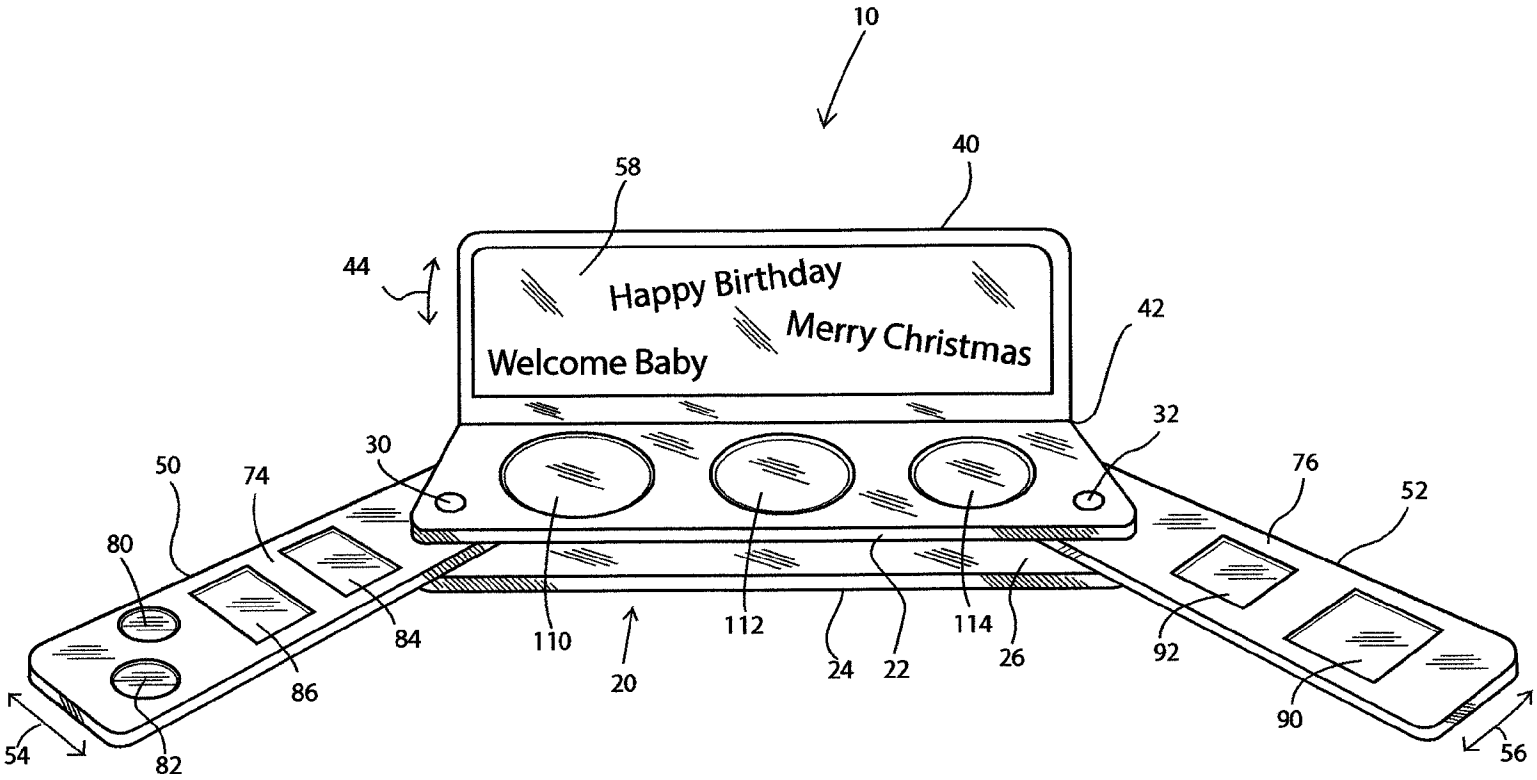
Happy Birthday
Merry Christmas
Welcome Baby
10
20
22
24
26
30
32
40
42
44
50
52
54
56
58
74
76
80
82
84
86
90
92
110
112
114

PARTY ACCESSORY STORAGE AND DISPLAY UNIT

CROSS REFERENCE TO RELATED APPLICATIONS

This application claims priority to U.S. Provisional Patent Application Ser. No. 62/723,080 filed Aug. 27, 2018 entitled "Party Unit Deluxe", the disclosure of which is incorporated herein by reference in its entirety.

BACKGROUND OF THE INVENTION

1. Field of the Invention

The present invention relates generally to the food service industry, and more particularly, to a device for displaying, transporting, and serving accessories for food items served at a social event, such as a party.

2. Brief Description of the Prior Art

Serving trays for holding food and beverages are commonplace. A typical example is shown in U.S. Pat. No. 3,722,781 issued to Page, et al. This serving tray includes a top portion and a bottom portion which are spaced-apart and which have appropriately sized openings for receiving and carrying drink containers and a relatively large opening which is sized to receive food items, such as hamburgers and French fries.

Carry-out trays are used extensively by concessionaires for mass spectator events, such as, for example, football games and baseball games. Such trays are also used for carrying food and beverages from roadside stands to customers seated in automobiles, as at so-called "drive-ins". The primary requirement for such a tray is that it be relatively inexpensive, since it is generally intended to be discarded after a single use. Consequently, it is generally the practice to fabricate such trays of paperboard or other inexpensive material. However, although the tray must be inexpensive, it must still be sufficiently sturdy to withstand the various forces which tend to deform the tray during the course of normal use. Furthermore, the tray must be provided with several compartments adapted to receive and retain beverage containers, as well as to act as receptacles for food items, such as sandwiches. These multi-compartment serving trays are usually carried from the serving counter to the place where the food or beverage is to be consumed. The food is placed in one or more compartments and a beverage cup is adapted to stand in another compartment. It is further necessary that the tray be constructed such that it is maintained in a flat position for easy storage in a restricted space and that the tray is readily erectable from its folded form. It is of great importance that once the tray is formed or erected, it remains as such during use.

Serving trays currently available in the marketplace may have many of the above-described characteristics, however, many may be complicated in design and costly to produce. Moreover, most currently available serving trays do not lend themselves to being erected and then easily dispensed by automatic machinery means.

Some serving trays currently available do not have a cover, resulting in the food getting cold in transit from the serving counter to the eating area. In addition, it tends to become awkward for the person who is carrying both the tray and a beverage cup, oftentimes resulting in spillage of the beverage, or the food, or both. Some currently available serving trays may be provided with a cover which is closed to keep the food warm; however, these serving trays do not provide for means for carrying a beverage cup. Hence, even with existing covered serving trays, beverage cups need to be carried separately.

The currently available serving trays are designed to receive and carry food and beverages from one location to an eating area. However, these serving trays are not designed to store and serve the serving accessories necessary to serve food and beverages. Also, these currently available serving trays are designed to accommodate food and beverages for a limited number of people.

There is, therefore, a need in the art to provide a storage and display unit, which is not only collapsible, but which is adapted to accommodate several serving accessories, such as, for example, plates, cups, straws, napkins, forks, knives, spoons and condiments.

There is a further need in the art to provide a storage and display unit which is easily collapsible for easy storage; which is easily transported with or without serving accessories, food, and/or beverages; and which is amenable for use by a group of people social gatherings, such as parties, sports events, and the like.

There is a further need in the art to provide a storage and display unit which can be pre-packed with serving accessories, such as, for example, plates, utensils, condiments, napkins, straws, and cups, and which unit can be easily stored in a convenient and efficient manner until needed for set up of a social event, and at which time, the serving accessories are readily available for rapid set up.

SUMMARY OF THE INVENTION

The present invention provides such a unit. The present invention provides a party accessory storage and display unit having a central portion with a first planar panel and a second planar panel being spaced apart from each other and connected to each other to form a U-shaped opening there between. A display panel is hingeably and detachably mounted on the central portion to move between an open position which is defined as being upright with respect to the central portion and a closed position which is defined as abutting or resting against the central portion. A first pivotal member and a second pivotal member are pivotably connected to the central portion to swing into and out of the U-shaped opening between a storage position inside the U-shaped opening and a serving position in which the first and second pivotal members are located outside the U-shaped opening. Each pivotal member has a top surface comprising a plurality of compartments which are constructed to support items for a social event, such as a party. The central portion also has a top surface with a plurality of compartments constructed to support items for the social event. A pivot pin is located in the planar panels for the rotational connection of the pivotal members relative to the central portion of the party accessory storage and storage unit.

The unit is foldable in that the two members are pivoted into the U-shaped opening and the display panel is pivoted down onto the central portion of the unit. The compartments of members and the central portion may be structured to receive cups, straws, forks, bowls, plates, napkins, condiments, and the like. Being foldable, the unit is easily adapted to be supported by different shaped and sized supports, such as a round, rectangular or square table. The unit is easy to set up, is easily collapsible, is easy to transport, and is easily stored. The unit is of a tri-fold construction such that when collapsed may be placed into a traveling carrying case. In some instances, the unit per se may be provided with a handle such that it becomes a self-contained traveling case when in a collapsed state.

The party accessory storage and display unit of the invention may be used in a store as a well as to display products for sale. The unit may also be used to display utensils or the like for use when having a party. The unit allows a user to grab what they need before they go to a food buffet.

These and other features and advantages of the present invention will be better appreciated and understood when the following description is read in light of the accompanying drawings.

BRIEF DESCRIPTION OF THE DRAWING

The components in the FIGURE are not necessarily to scale, emphasis instead being placed upon illustrating the principles of the invention.

FIG. 1 is a schematic, front perspective view of a party accessory storage and display unit of the present invention.

DETAILED DESCRIPTION OF THE INVENTION

The single FIGURE, FIG. 1, illustrates a party accessory storage and display unit 10, which comprises a central portion 20 formed by two spaced-apart planar panels 22 and 24 defining a U-shape opening 26 there between. Pivot pins 30 and 32 are positioned respectively adjacent to corners 34, 36 of spaced-apart planar panels 22, 24. A display panel 40 is detachably mounted on central portion 20 by a hinge 42 which is provided in order for the display panel 40 to be moved toward and away from central portion 20, as indicated by the double-headed arrow 44. As shown in the FIGURE, display panel 40 is in an upright position with respect to central portion 20; however, it is apparent that display panel 40 may be folded or swung downwardly to rest against top panel 22.

Pivot pin 30 connects central portion 20 to a first pivotal member 50, and pivot pin 32 connects central portion 20 to a second pivotal member 52, in a manner such that pivotal members 50 and 52 are movable into and out of opening 26 as indicated by the double-headed arrows 54 and 56, respectively. Rotation of first and second pivotal members 50, 52 into opening 26 defines a storage position for storage and display unit 10; whereas, rotation of first and second pivotal members 50, 52 outwardly from opening 26 defines a serving position for storage and display unit 10, more about which is discussed herein below. In the FIGURE, a serving position for party accessory storage and display unit 10 is illustrated.

Conversely, when in a storage position, first and second pivotal members 50, 52 are positioned one on top of each other when they are stowed in opening 26. When stored in opening 26, pivotal members 50, 52 fit neatly relative to each other and relative to opening 26 so that display panel 40 may be folded down to rest on top of top panel 22. When pivotal members 50, 52 are thus stored, unit 10 is easily transported. In some instances, display panel 40 may contain indicia, such as "Happy Birthday", "Welcome Baby", and "Merry Christmas" as indicated at reference numeral 58 in the FIGURE. As such, display panel 40 may be a chalk board or the like so that indicia may be easily applied there on.

Each pivotal member 50, 52 has a top surface which is easily seen when members 50, 52 are rotated outwardly relative to opening 26 to define a serving position for storage and display unit 10. As illustrated in the FIGURE, top surface 74 of member 50 includes several compartments as indicated by reference numerals 80, 82, 84, and 86. Circular compartments 80 and 82 may contain eating accessory items, such as, for example, drinking cups. Rectangular compartment 84 may contain forks, spoons, and/or knives; and rectangular compartment 86 may contain straws. Top surface 76 of second pivotal member 52 contains rectangular units or compartments 90 and 92. Compartment 90 may contain condiments and compartment 92 may contain napkins. Top surface 100 of top panel 22 has a plurality of compartments, as indicated at reference numerals 110, 112, and 114.

Compartment 110 may contain bowls; compartment 112 may contain large plates; and compartment 114 may contain small plates, such as dessert plates. Even though not shown, additional compartments may be included in the invention without departing from the scope of the disclosure as is apparent to one skilled in the art. Thus, as disclosed herein above, the storage and display unit 10 is comprised of several compartments which are constructed to hold accessories for serving food. It is to be further appreciated, that the compartments of storage and display unit 10 of the present invention may be constructed to hold food items, per se, such as, for example, sandwiches, luncheon meats, salads, buns, cookies, cakes, and the like.

The pivotal members 50, 52 are interleaved in opening 26 during storage and have sufficient spacing between them to store items on them during such storage. In this manner, a complete party or social gathering set up may be prepared prior to the actual social event and then stored for future use. This makes a party or social gathering set up quick, efficient and easy. The storage and display unit 10 of the invention may also be stored in a carrying case (not shown) for easy transport. Conversely, the unit 10 may include an external handle wherein the unit 10 can be collapsed an in manner apparent from the above description and then manually transported.

The party accessory storage and display unit 10 of the invention is comprised of relatively rigid material, such as, for example, plastic. Even though the single FIGURE shows the compartments are being relatively shallow, it is to be appreciated that the compartments of first and second pivotal members 50, 52 and central portion 20, along with first and second pivotal members 50, 52 and central portion 20 will have the necessary depth to hold and carry the accessory items in unit 10.

While the present invention has been described in connection with the preferred embodiments of the single FIGURE, it is to be understood that other similar embodiments may be used or modifications and additions may be made to the described embodiment for performing the same function of the present invention without deviating there from. For example, even though the party accessory storage and display unit 10 of the present invention has been disclosed herein above as comprising a plurality of compartments for accommodating party accessories, such as napkins, forks, spoons, straws, and the like, the compartments may also accommodate food and beverages for the social event. Accordingly, it is intended by the appended claims to cover all such changes and modifications as come within the spirit and scope of the invention.

What is claimed is:

1. A party accessory storage and display unit, comprising:

a central portion having a first planar panel and a second planar panel, the first and second planar panels being spaced apart from each other and connected to each other to form a U-shaped opening there between;

a display panel hingeably and detachably mounted on central portion to move between an open position upright with respect to the central portion and a closed position adjacent to the central portion;

a first pivotal member and a second pivotal member being pivotally connected to the central portion to move into and out of the U-shaped opening between a storage condition inside the U-shaped opening and a serving position in which the first pivotal member and the second pivotal member are located outside the U-shaped opening;

the first pivotal member and the second pivotal member each having a surface which is a top surface comprising a plurality of compartments constructed to support items for a social event; and the central portion having a top surface and a plurality of compartments constructed to support items for the social event.

2. The party accessory storage and display unit of claim 1, further comprising a pivot pin for pivotally connecting the first pivotal member and the second pivotal member to the central portion of the unit.

3. The party accessory storage and display unit of claim 1, wherein the display panel includes a chalk board for selectively receiving and displaying indicia.

4. A party accessory storage and display unit, comprising:

a central portion having a U-shaped opening defined therein and a top surface defining the U-shaped opening;

at least a first pivotal member and a second pivotal member, each having a top surface and each pivotably mounted on the central portion to move between a first position located inside the U-shaped opening of the central portion and a second position extending outwardly of the U-shaped opening of the central portion; and a plurality of storage compartments defined on the top surface of each first pivotal member and second pivotal member and on the top surface of the central portion, each storage compartment being adapted to accommodate an accessory for a social event.

5. The party accessory storage and display unit of claim 4, further comprising a display panel hingeably mounted on the central portion for selectively receiving and displaying indicia, and wherein the display panel includes a chalk board.

* * * * *